US007085510B2

(12) United States Patent
Rosenstock

(10) Patent No.: US 7,085,510 B2
(45) Date of Patent: Aug. 1, 2006

(54) SAFETY APPARATUS TO SUPPRESS THE SPREAD OF FIRE FROM A FIXING CHAMBER OF A FIXING STATION IN AN ELECTROPHOTOGRAPHIC PRINT OR COPY DEVICE

(75) Inventor: Günter Rosenstock, Ottobrunn (DE)

(73) Assignee: Oce Printing Systems GmbH, Poing (DE)

( * ) Notice: Subject to any disclaimer, the term of this patent is extended or adjusted under 35 U.S.C. 154(b) by 34 days.

(21) Appl. No.: 10/888,425

(22) Filed: Jul. 9, 2004

(65) Prior Publication Data

US 2005/0019055 A1 Jan. 27, 2005

(30) Foreign Application Priority Data

Jul. 21, 2003 (DE) ..... 103 33 106

(51) Int. Cl.
*G03G 21/20* (2006.01)

(52) U.S. Cl. ..... 399/91; 399/94; 399/320

(58) Field of Classification Search ..... 399/91, 399/94, 107, 122, 320, 324, 327
See application file for complete search history.

(56) References Cited

U.S. PATENT DOCUMENTS 3,979,161 A * 9/1976 Kremer et al. ..... 355/133
4,402,594 A * 9/1983 Pelda et al. ..... 399/91
5,010,137 A 4/1991 Umeda et al.
5,805,969 A 9/1998 Elsermans et al.
6,392,209 B1 5/2002 Oppitz
6,449,458 B1 9/2002 Lang et al.

FOREIGN PATENT DOCUMENTS

| | | |
|---|---|---|
| DE | 198 23 494 | 8/1999 |
| DE | 198 27 210 | 12/1999 |
| DE | 69613057 | 9/2001 |
| JP | 0 517 3402 | 7/1993 |
| JP | 2000155495 | 6/2000 |

* cited by examiner

*Primary Examiner*—Hoang Ngo
(74) *Attorney, Agent, or Firm*—Schiff Hardin LLP

(57) ABSTRACT

To suppress spread of fire from a fixing chamber of a fixing station in an electrophotographic print or copy device, in the event of a fire, in order to partition a fixing chamber for a recording medium in a fireproof manner, arranged at the openings of the fixing chamber is a safety apparatus made of an elastic sealing element and a counter-element, between which the recording medium is guided through. The sealing element is comprised of a fiberglass tube, inside which an elastic filling material or an elastic spreading element is situated. When the sealing element is pressed on the counter-element, a clamp region for the recording medium is formed, via which the opening of the fixing chamber can be sealed and a burning segment of the recording medium can be extinguished. Additionally, ashes present on the recording medium can be removed.

38 Claims, 7 Drawing Sheets

SAFETY APPARATUS TO SUPPRESS THE SPREAD OF FIRE FROM A FIXING CHAMBER OF A FIXING STATION IN AN ELECTROPHOTOGRAPHIC PRINT OR COPY DEVICE

BACKGROUND

The use of radiant heat devices in a fixing chamber to fix toner images in the fixing station of an electrophotographic print or copy device is, for example, known from DE 198 27 210 C1. The heat rays of the radiant heat device are deflected onto the toner images present on a recording medium, for example paper, the toner images being thereby fixed in the recording medium. However, the use of heat rays has the disadvantage that the heating and cooling of the recording medium is connected with a relatively high time constant, whereby given the start of the print event problems occur given downtime or given intermittent printing. In DE 198 27 210 C1, to prevent these problems it is proposed to provide a covering device (also called a blind) that can be moved into the beam path between the radiant heat device and the recording medium.

When, in spite of the blind, in the case of failure a burning of the recording medium occurs, it is necessary to seal the openings of the fixing chamber for the recording medium such that the fire cannot spread over the fixing chamber. What are called safety bulkheads are used for this that should fulfill the following requirements:

- In the event of failure, the openings should be sealed such that no flames can spurt out from the fixing chamber.
- A burning of the recording medium must be stopped over its entire width, such that no embers arrive outside through the bulkheads, not even when the recording medium transport extracts the burning recording medium from the fixing chamber with process speed. The embers of the burn edge must be smothered by the bulkhead upon being pulled through, and the hot ash residues must be stripped off. The clamping force of the bulkhead may not hinder the removal of the recording medium.
- The materials used must be selected such that they can at least temporarily resist the flames and the occurring temperatures of up to approximately 1000° C.

A fixing station with a fixing chamber with radiant heat devices is known from DE 696 13 057 T2. Surface treatment rollers with which a glossy surface of the recording medium should be achieved are arranged at the output for the recording medium. The surface treatment rollers comprise a rigid core that can be provided with an elastomer covering. The rollers can be movable and can close under the force of a spring. The output of the fixing chamber can thereby be sealed, whereby fire should be contained in the fixing chamber.

A problem to be solved is to provide a safety device (safety bulkhead) with which the requirements specified above are safely fulfilled.

SUMMARY

In a method and apparatus that prevents fire from exiting a fixing chamber of a fixing station in an electrophotographic printer or copy device, an opening of the fixing chamber via which a fire can spread is provided with a sealing device that can be sealed as needed. The sealing device comprises a sealing element that cooperates with a counter-element. At least one of the sealing element and the counter-element comprise an elastic sealer that is flattened after the sealing element is pressed onto the counter-element, such that a clamp region is created by which the openings of the fixing chamber are sealed fire-tight.

DESCRIPTION OF THE PREFERRED EMBODIMENTS

Figure 1:
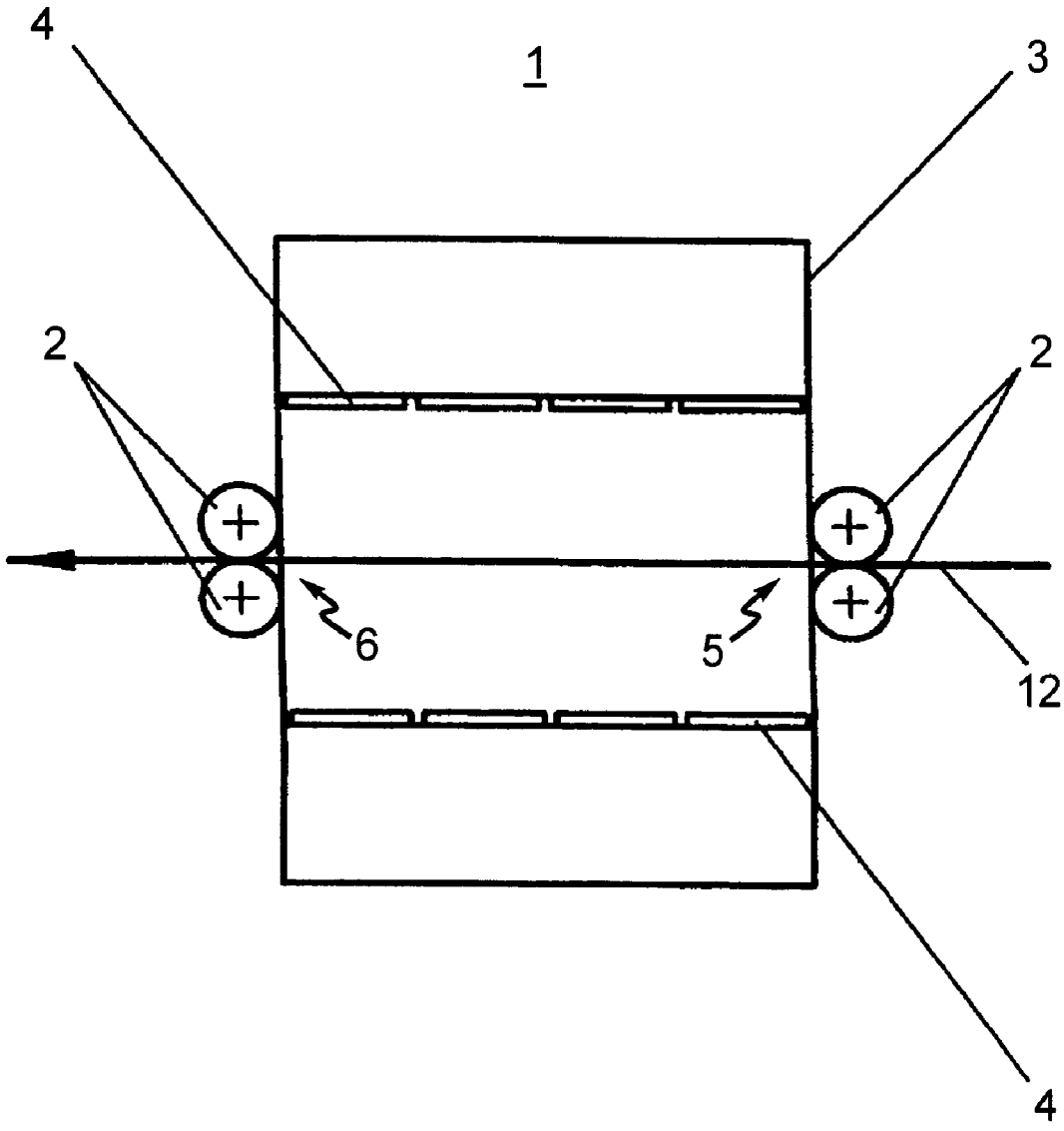
FIG. 1 illustrates a principle representation of a fixing chamber with arrangement of the safety apparatuses.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The safety device comprises an elastic sealing element with a sealer and a counter-element, has a series of advantages:

- finishing tolerances are compensated by the elastic sealer;
- a clamp region is achieved that can cover a length of multiple mm;
- when a burning recording medium is drawn through the clamping region, the flames are smothered on the recording medium and ashes adhering there are stripped off.

The sealing element comprises a sealer that can be realized as tube-like fiberglass fabric (called fiberglass tubes in the following). The fiberglass fabric is very flexible and temperature-resistant up to over 1000° C. and can at least temporarily insulate materials contained in the tube, and thus prevent the destruction of the sealing element. In addition, the fiberglass fabric is very robust and insensitive to improper treatment. Very abraded or scraped glass fibers are damaging neither to the electronics nor to the heat radiator. In addition, the rough surface structure of the fiberglass fabric benefits the stripping of ash and ember residues upon pulling the recording medium through the safety device.

In order to achieve a defined region (clamp region) at which the sealer is flattened, a filling material that can be comprised of temperature-resistant, elastic, porous material can be arranged in the fluid bearing tube. Examples are glass wool, foam plastic or silicone rubber.

It is likewise possible to arrange an elastic spreader element inside the fiberglass tube, the elastic spreader element being capable of being pressed together to form a clamp region. The spreading element can thereby be positioned in the fiberglass tube. For example, the spreading element can be arranged on guide rods, via movement of which on the recording medium the clamp region is achieved with the counter-element. Or the sealing element can be kept outside while the spreading element is freely arranged inside the fiberglass tube. Another embodiment can exist in that the spreading element is pinched in the fiberglass tube and the sealing element is inserted into a mounting that can be moved.

The sealing element can, for example, be executed such that the sealer comprises a sealing roller. This solution has the advantage that the recording medium can easily be extracted from the fixing chamber. Furthermore, the sealer can also be realized as a bulge arranged in a mounting.

All of these realizations of the sealing element have the advantage that a wider clamp region can be realized via the elasticity and compressibility of the filling material or via the spring properties of the spreading element inside the fluid bearing tube, even given small clamping forces. Thus finishing tolerances, heat distortion and other imprecisions can be compensated. In addition, these examples show that the sealing element, with the fluid bearing tube, allows a large number of realizations and thus can be easily adapted to the most different application cases.

The counter-element is designed such that the necessary clamp region can be generated given cooperation with the sealing element. Examples are:

a planar or (convex or concave) rounded movable surface;

a roller;

an execution that corresponds with the sealing element.

In a further advantageous embodiment, the sealing element can be realized as a brush strip. The brush strip then comprises metal wires as bristles, for example made from brass or steel, that are contained in a strip. A clamp plate or likewise a brush strip can be provided as a counter-element. The metal wires are appropriately cut at a lengthwise slant at their free ends (wire ends), such that upon closing the safety apparatus the wire ends pivot on the counter-element and thus uniformly cover the recording medium over a clamp region of a few mm. Ember residues are then well stripped by the bristle ends upon extraction of the recording medium from the fixing chamber. Given a diameter of approximately 0.05 to 0.5 mm, advantageous dimensions of the metal wires can be at a length of approximately 5 to 120 mm.

Both the sealing element and the counter-element are swiveled towards one another or away from one another upon sealing or opening of the openings of the fixing chamber. The sealing element and possibly the counter-element can be driven in an advantageous manner by a stepping motor that is controlled dependent on a signal of a smoke detector that is arranged in the fixing chamber.

The design of a fixing station 1 in principle representation arises from FIG. 1. This comprises a fixing chamber 3 in which heat radiators 4 are arranged. Guided through the fixing chamber 3 is a recording medium 12 on which toner images of the images to be printed are applied that are melted by the radiant heat from the heat radiators 4. The recording medium 12 is introduced into the fixing chamber 3 via an entrance opening 5 and exits from the fixing chamber 3 at the exit opening 6. For further details with regard to the design of the fixing station, reference is made to DE 198 27 210 cited above, which is included in this disclosure or to DE 696 13 057 T2, also included in this disclosure.

In the event of burning, in order to prevent a spread of the fire from the fixing chamber 3, safety apparatuses 2 are arranged at its openings 5 and 6 that, in this emergency, seal the openings 5 and 6. Resulting from the drawing Figures are safety apparatuses 2 that for this can be used as safety bulkheads in the event of burning in order to prevent an exit of the fire from the fixing chamber 3. Such a safety apparatus 2 is to be arranged at all openings of the fixing chamber 3 from which fire can escape.

Figure 2:
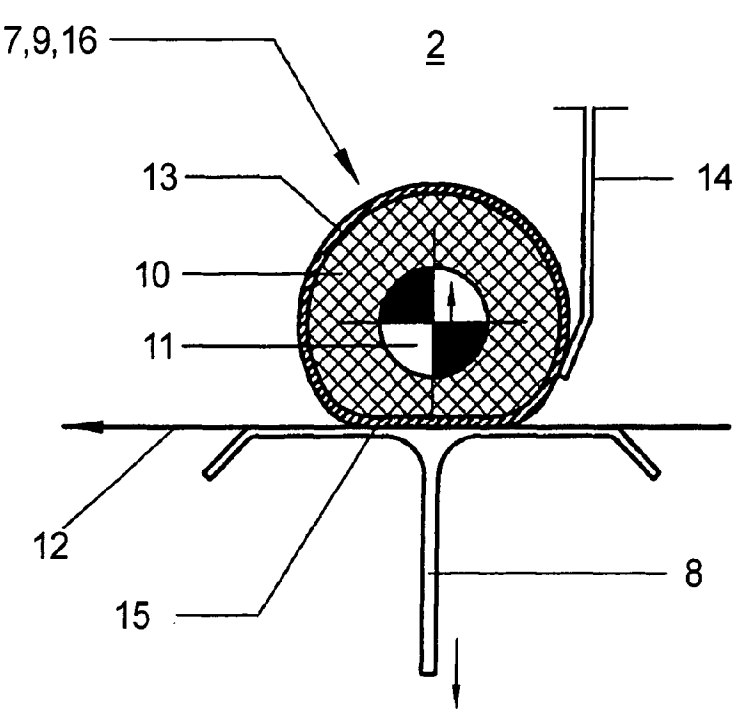
FIG. 2 illustrates an embodiment of the sealing element as a roller that cooperates with a planar counter-element.

A safety apparatus 2 as a type of a sealing device that comprises a sealing element 7 and a counter-element 8 is shown in FIG. 2. The sealing element 7 comprises a sealer 9 that is realized as a sealing roller 16. The sealer 9 is designed from a tube-like fiberglass fabric 13 (fiberglass tube) filled inside with a filling material 10. The sealer 9 is positioned on a guide rod 11.

A counter-element 8 cooperates with the sealing element 7 and thus forms a sealing device. In FIG. 2 it is designed planar and can be moved. A recording medium 12 can be guided through between sealing element 7 and counter-element 8. Additionally, a fixed sealing lip 14 that further improves the function of the safety apparatus 2 to suppress an exit of a fire from the fixing chamber 3 can be positioned at the sealer 9 adjacent to the fiberglass tube 13.

As long as no fire has broken out in the fixing chamber 3, the recording medium 12 moves freely through the safety apparatus 2. However, if a fire is reported, the safety apparatus 2 seals the associated opening of the fixing chamber 3. This means that the sealing element 7 and the counter-element 8 are moved towards one another until the sealer 9, via cooperation with the counter-element 8, forms a flattened region (the clamp region 15) on the recording medium 12 through which the recording medium 12 is drawn. A spread of a fire from the fixing chamber 3 is thereby prevented, and at the same time fire **6*n* the recording medium 12 is extinguished and ashes on the recording medium 12** are wiped off.

In the exemplary embodiment of FIG. 2, the counter-element 8 and the sealing element 7 are moved towards one another (in the event of fire) or moved away from one another (in the event that no interference exists).

Figure 3:
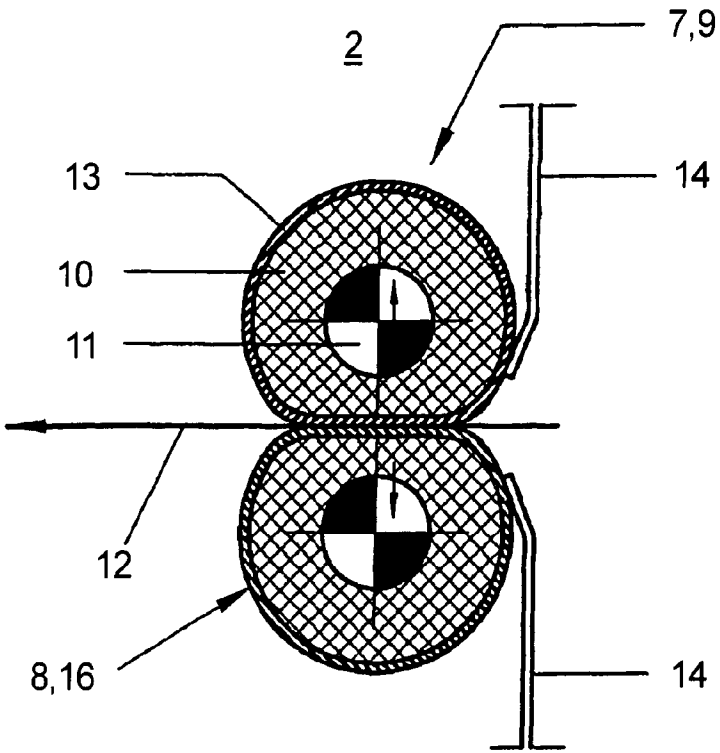
FIG. 3 shows an embodiment of the sealing element as a roller that cooperates with a roller-shaped counter-element.

FIG. 3 differs from FIG. 2 only in that a sealing roller 16 corresponding to the sealing element 7 is used as a counter-element 8. In contrast to FIG. 2, a fixed sealing lip 14 here likewise lies on the counter-element, since there the counter-element 8 can be designed such that it can assume the function of the sealing lip 14. This embodiment is particularly advantageous for the case that the recording medium 12 should be removed from the fixing chamber 3. Here as well, the state is shown in which the safety apparatus 2 is closed.

Figure 4B:
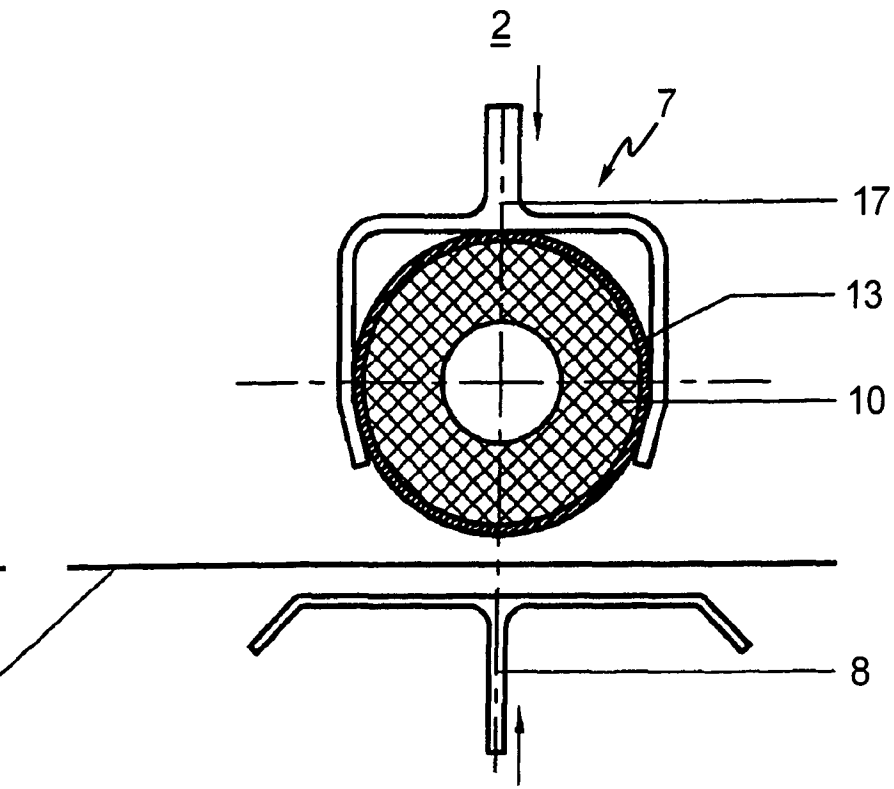
FIG. 4 illustrates an embodiment of the sealing element as a bulge that cooperates with a planar counter-element, in the opened and closed state.
Figure 4A:
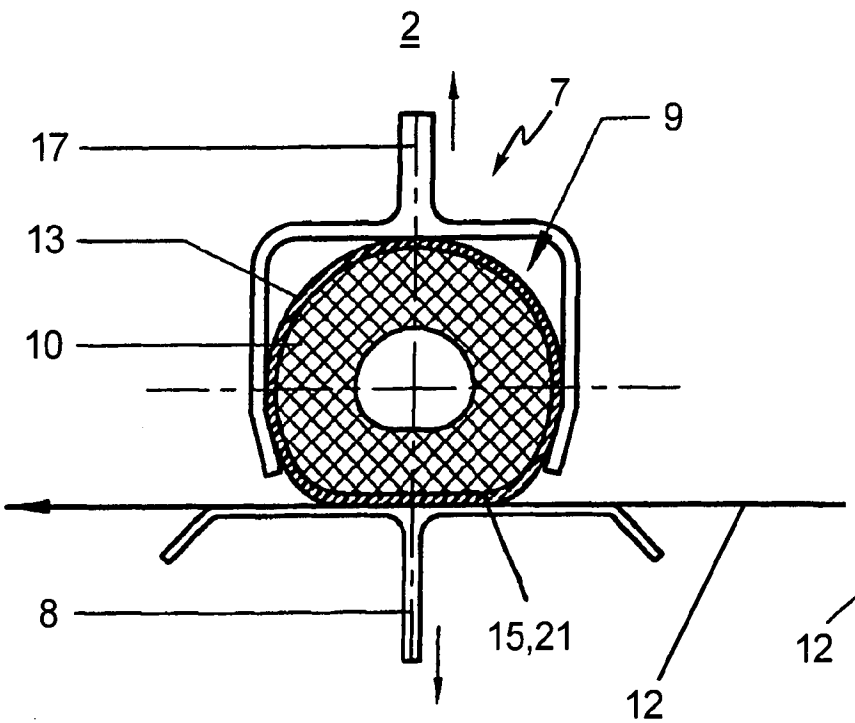

In a further exemplary embodiment (FIG. 4), a sealer 9 is provided that is hollow inside, otherwise the sealer 9 is comprised of a fiberglass tube 13 and the filling material 10. The sealer 9 is externally mounted via a mounting 17. When here the sealing element 7 is applied to the counter-element 8 with corresponding pressure, a flattened region (clamp region 15) forms. FIG. 4*a* thereby shows the closed state of the safety apparatus 2, and FIG. 4*b* the opened state. The counter-element 8 here is designed planar.

Figure 7:
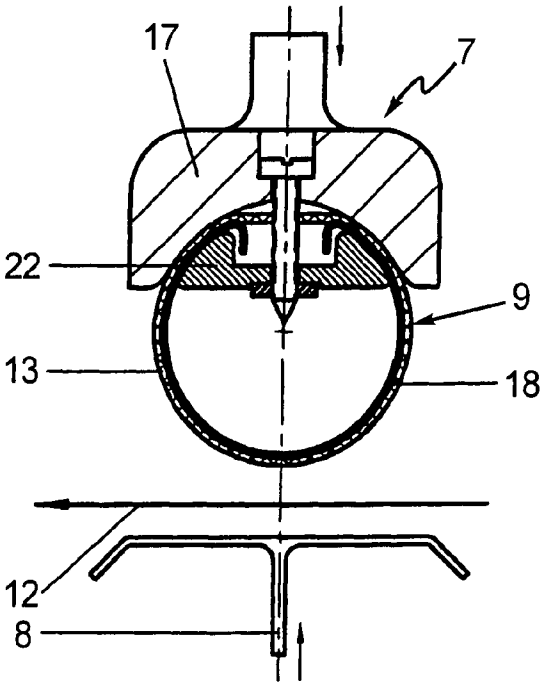
FIG. 7 illustrates a third embodiment of the sealing element with a spreading element that cooperates with a planar counter-element.
Figure 6:
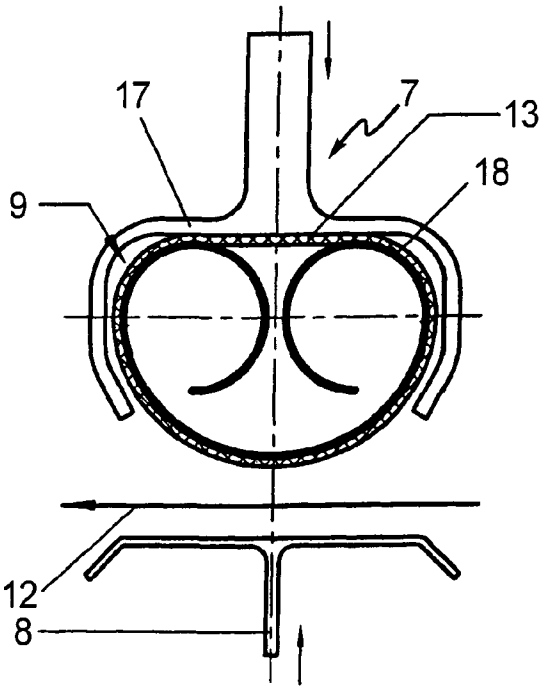
FIG. 6 illustrates a second embodiment of the sealing element with a spreading element that cooperates with a planar counter-element.
Figure 5:
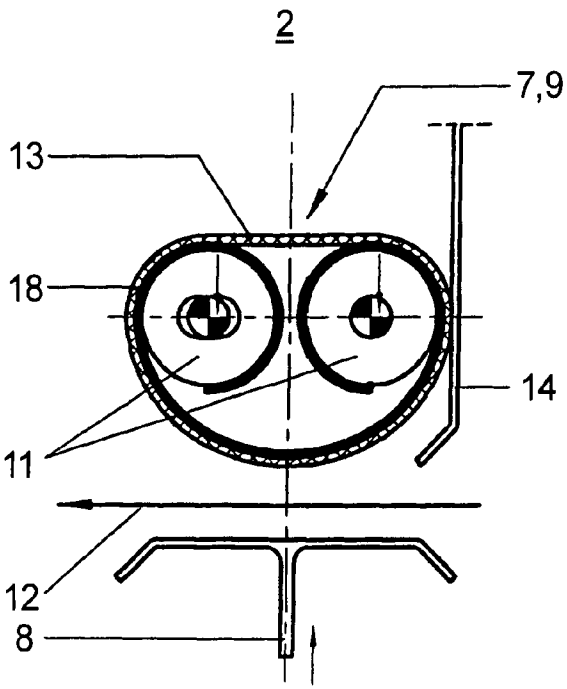
FIG. 5 illustrates a first embodiment of the sealing element with a spreading element that cooperates with a planar counter-element.

FIG. 5–7 show exemplary embodiments in which, instead of the filling material, an elastic spreading element 18 is arranged inside the fiberglass tube 13.

From FIG. 5, a solution results in which a spreading element 18 positioned on guide rods 11 is arranged inside the fiberglass tube 13. The counter-element 8 is designed planar. A fixed sealing lip 14 is in turn arranged on the sealer 9. Given motion of the guide rods 11 towards the recording medium 12, the sealing element 7 impinges on the counter-element 8 and is deformed, such that a clamp region is created. If the sealing element 7 is moved back, due to the elastic effect of the spreading element 18 the sealer 9 assumes its original shape.

From FIG. 6, a solution results in which the spreading element 18 is arranged unmounted inside the fiberglass tube 13. The sealer 9 here lies outside in a mounting 17. The movement of the sealing element 7 here occurs via the mounting 17. When the mounting 17 presses the sealer 9 against the counter-element 8, the spreading element 18 deforms and thereby generates the clamp region 15. Given the opposite motion, the spreading element 18 relaxes again and assumes the shape according to FIG. 6.

From FIG. 7, a third embodiment of the sealing element 7 results with a spreading element 18. Here the spreading element 18, which is realized as a ring, is arranged in a clamping 22 inside the fiberglass tube 13. A mounting 17 comprises the sealer 9. Via movement of the mounting towards the counter-element 8, a deformation of the fiberglass tube 13 can be achieved in order to generate the clamp region.

Figure 8B:
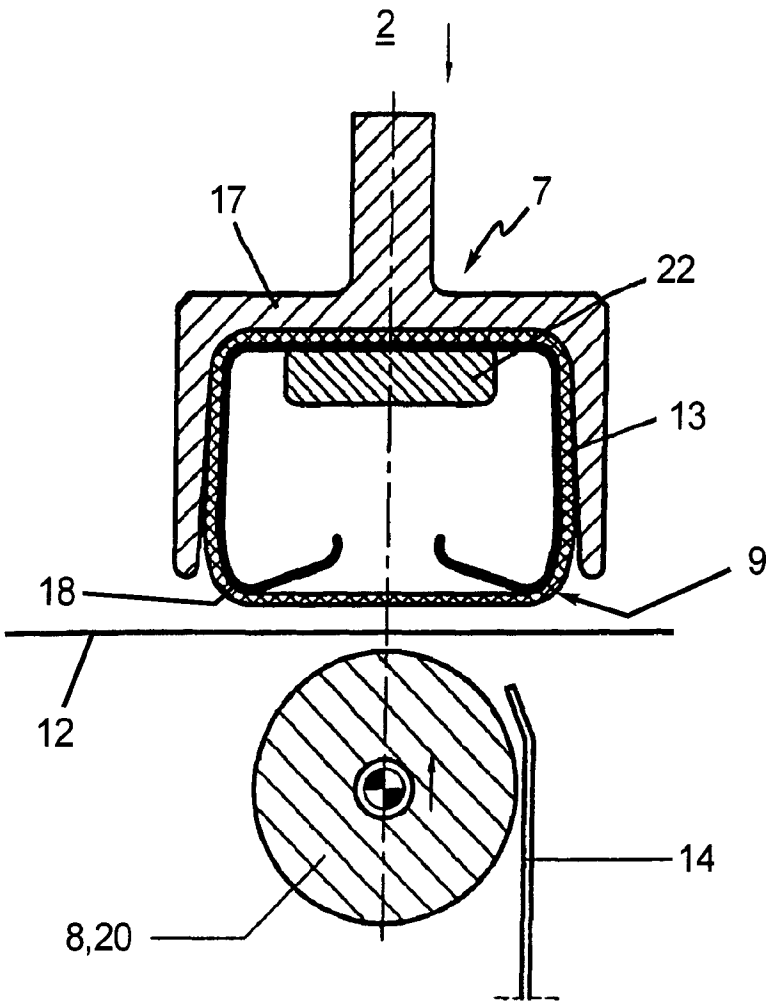
FIG. 8 illustrates a fourth embodiment of the sealing element with a spreading element that cooperates with a roller-shaped counter-element, in the closed and opened state.
Figure 8A:
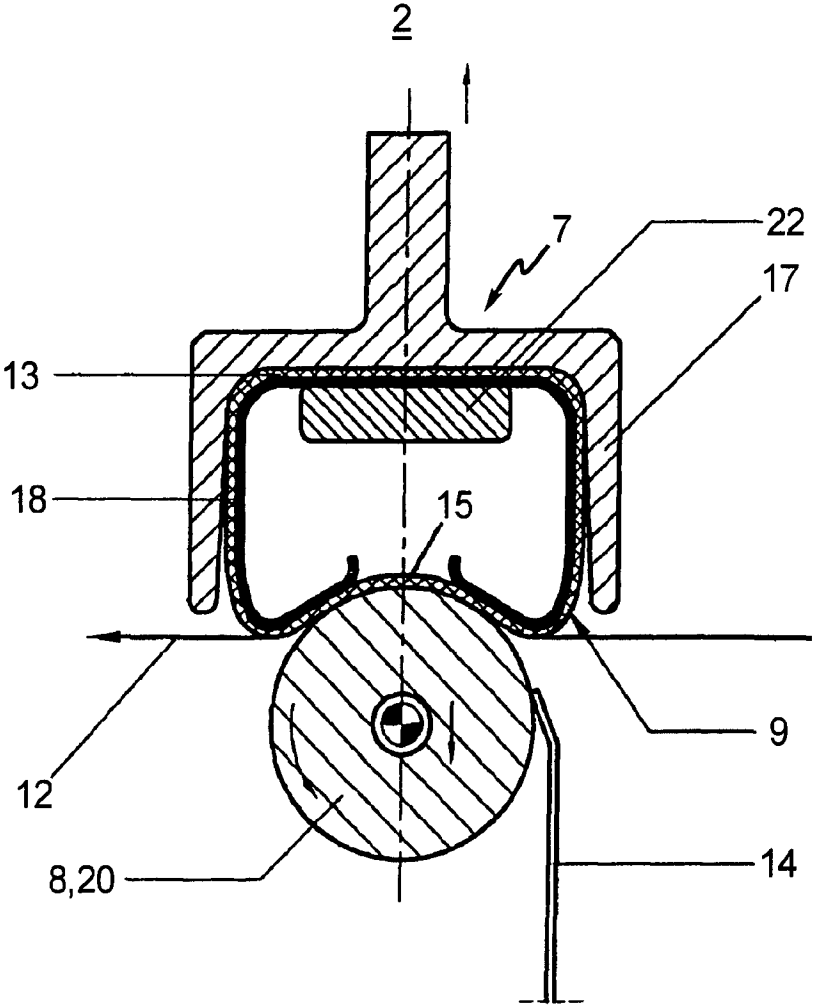

In the exemplary embodiments of FIGS. 5 through 7, a planar, stamp-like element is provided as a counter-element 8. Naturally, a roller-like counter-element can also be provided. This case can be learned from FIG. 8. Here a sealing element 7 is likewise provided that, as a sealer 9, provides a fiberglass tube 13 with clamped (by a clamping 22) spreading element 18 arranged inside. The sealer 9 is arranged in a mounting 17. The counter-element 8 is realized as a roller 20 on which, for example, a fixed sealing lip 14 can be attached. FIG. 8*a* shows the case in which the sealing element 7 is pressed on the counter-element 8 to form the clamp region 15. From FIG. 8*b*, the case results in which the sealing element 7 is turned away from the counter-element 8.

Figure 9A:
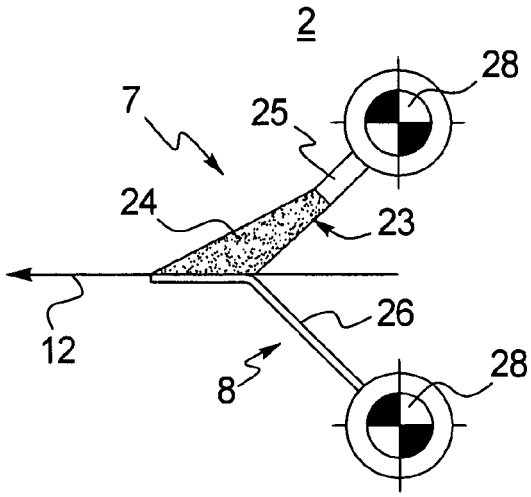
FIG. 9 illustrates a fifth embodiment of the sealing element with a brush strip and a clamp plate as a counter-element, in the closed and opened state.
Figure 9B:
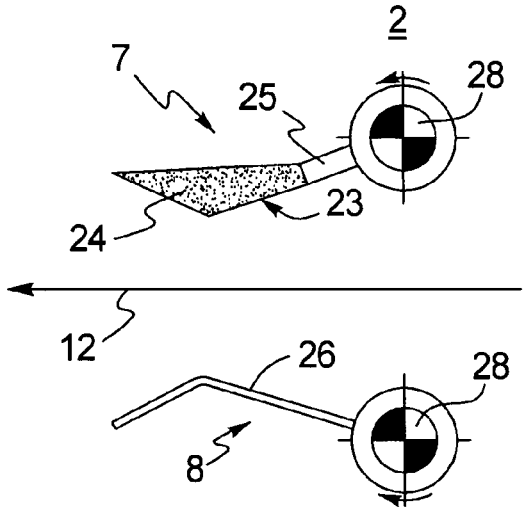

FIG. 9 shows a safety apparatus 2 with a sealing element 7 made of a brush strip in which the metal wires (bristles) 24 are contained in a strip 25. The brush strip 23 can be rotated around a pivot bearing 28. On the other side of the recording medium 12, a clamp plate 26 that can likewise be rotated around a pivot bearing 28 arranged as a counter-element 8. The openings of the fixing chamber can be closed or opened via a counter-rotation of brush strip 23 and clamp plate 26. FIG. 9*a* shows the case in which the safety apparatus 2 is closed, FIG. 9*b* the case in which the safety apparatus 2 is opened.

Figure 10A:
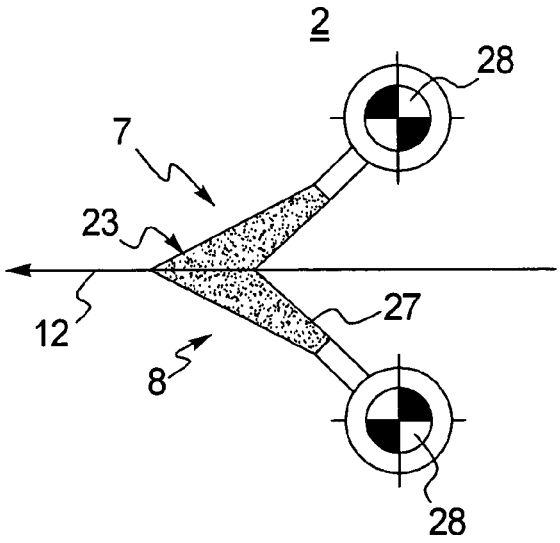
FIG. 10 illustrates a fifth embodiment of the sealing element with a brush strip and a brush as a counter-element, in the closed and opened state.
Figure 10B:
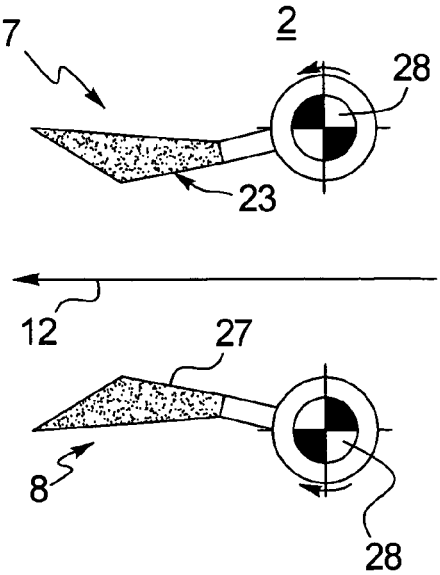

A development of FIG. 9 results from FIG. 10. Here the counter-element 8 has likewise been realized as a brush strip (clamp brush 27) corresponding to the brush strip 23 in FIG. 9. FIG. 10*a* in turn shows the safety apparatus 2 in the closed state, FIG. 10*b* in the opened state.

Figure 11:
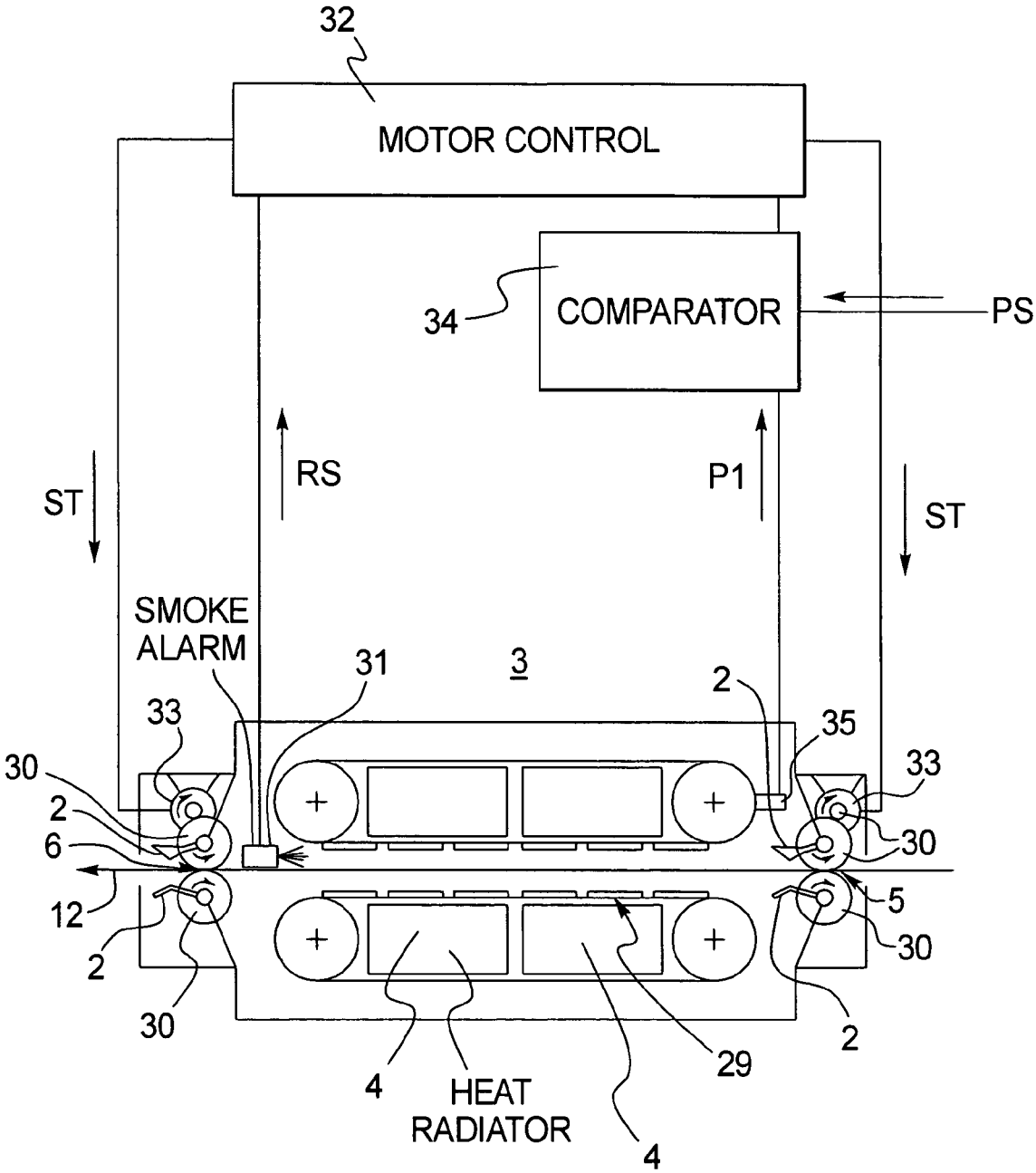
FIG. 11 illustrates an arrangement to control the safety apparatus.

In FIG. 11, a possible control of the safety apparatus 2 is shown. Assume a fixing chamber 3 corresponding to DE 198 27 210 C1 or FIG. 1. This comprises heat radiators 4 on both sides of recording medium 12. Respectively one blind 29 that is designed corresponding to DE 198 27 210 C1 (to which reference is made) is arranged between the heat radiators 4 and recording medium 12. Respectively one safety apparatus 2 that is realized corresponding to FIG. 9 in the exemplary embodiment and shown in the open state is arranged at the input 5 and the output 6. Furthermore, a smoke alarm 31 that emits a smoke alarm signal RS when smoke develops due to fire in the fixing chamber 3 is arranged in the fixing chamber 3. The smoke alarm 31 in this case emits the smoke alarm signal RS that is supplied to a motor control 32. The motor control 32 controls a motor 33 with a control signal ST corresponding to the smoke alarm signal RS, for example a step motor that, for example, moves a gearwheel 30 on whose axis the safety apparatus 2 is arranged. In the exemplary embodiment, additionally a further gearwheel 30 is provided on which the counter-element lies, such that this is also pivoted when the openings 5, 6 should be closed. In addition to the monitoring of the smoke alarm signal RS, the motor control 32 can still be influenced dependent on the position of the blind 29. With the aid of a position detector 35 (position signal PI), it is determined in a comparator 34 whether the position of the blind 29 corresponds to the desired position PS. When this is not the case, the danger exists that a fire could break out in the fixing chamber 3. As a precaution, the safety apparatuses 2 can then be closed.

A number of embodiments of the safety apparatus 2 result from the Figures. These examples show that the safety apparatus 2 can be adapted in large measure to the respective application case. Naturally, the width of the safety apparatus 2 is to be selected such that the corresponding opening can completely seal the opening of the fixing chamber.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

I claim as my invention:

1. A safety apparatus to prevent spread of fire from a fixing chamber of a fixing station in an electrophotographic print or copy device, comprising:

at openings of the fixing chamber via which a fire can spread, a sealing device that can be sealed as needed, said sealing device comprising a sealing element that cooperates with a counter-element; and at least one of the sealing element and the counter-element comprising an elastic sealer that is flattened after the sealing element is pressed onto the counter-element, such that a clamp region is created via which the openings of the fixing chamber are sealed fire-tight.

2. A safety apparatus according to claim 1 in which the openings of the fixing chamber are an entrance and exit opening for a recording medium that runs through between the sealing element and the counter-element and is pinched over its entire width.

3. A safety apparatus to prevent spread of fire from a fixing chamber of a fixing station in an electrophotographic print or copy device, comprising:

at openings of the fixing chamber via which a fire can spread, a sealing device that can be sealed as needed, said sealing device comprising a sealing element that cooperates with a counter-element;

at least one of the sealing element and the counter-element comprising an elastic sealer that is flattened after the sealing element is pressed onto the counter-element, such that a clamp region is created via which the openings of the fixing chamber are sealed fire-tight; and the sealer comprises a fiberglass tube.

4. A safety apparatus according to claim 3 in which the fiberglass tube comprises a temperature-resistant, elastic filling material.

5. A safety apparatus according to claim 4 in which the filling material is porous.

6. A safety apparatus according to claim 4 in which the filling material comprises at least one of glass wool, foam plastic and silicone rubber.

7. A safety apparatus according to claim 1 in which the sealing element comprises a supported sealing roller.

8. A safety apparatus according to claim 1 in which the sealing element comprises an external mounted sealing clamp region.

9. A safety apparatus according to claim 3 in which the sealer comprises a spreading element arranged inside the fiberglass tube.

10. A safety apparatus according to claim 9 in which the spreading element is held in guide rods.

11. A safety apparatus according to claim 9 in which the sealer is made of a fiberglass tube and a spreading element is arranged externally in a mounting.

12. A safety apparatus according to claim 9 in which the spreading element is arranged inside the fiberglass tube in a clamping and the sealer is attached in a mounting.

13. A safety apparatus according to claim 1 in which the counter-element comprises at least one of a planar, concave, and convex curved surface.

14. A safety apparatus according to claim 1 in which the counter-element comprises a roller.

15. A safety apparatus according to claim 1 in which the counter-element is designed like the sealer.

16. A safety apparatus according to claim 1 in which a fixed sealing lip is attached to the sealing element.

17. A safety apparatus according to claim 1 in which the sealing element comprises a brush strip.

18. A safety apparatus according to claim 17 in which the brush strip comprises metal wires that are contained in a strip at one end, and at the other free end upon closing they rest on the recording medium such that a clamp region is created.

19. A safety apparatus according to claim 18 in which free ends of the wires are cut at a slant lengthwise.

20. A safety apparatus according to claim 18 in which the wires exhibit a diameter of approximately 0.05 to 0.5 mm.

21. A safety apparatus according to claim 18 in which a length of the wires from the strip to the free ends is 5 to 120 mm.

22. A safety apparatus according to claim 18 in which the wires comprise brass wires.

23. A safety apparatus according to claim 18 in which the wires comprise steel wires.

24. A safety apparatus according to claim 17 in which the counter-element comprises a clamp plate.

25. A safety apparatus according to claim 17 in which the counter-element comprises a brush strip.

26. A safety apparatus according to claim 1 in which a motor is coupled with the sealing element, said motor being connected with a motor control that controls the motor dependent on a signal from a smoke detector arranged in the fixing chamber.

27. A safety apparatus according to claim 26 in which the sealing element is coupled with the counter-element such that the counter-element is pivoted with the sealing element, pivot motions of the sealing element and the counter-element being in opposite directions.

28. A safety apparatus according to claim 26 in which heat radiators are arranged in the fixing chamber, in which a movable blind is arranged between at least one heat radiator and recording medium, and the motor control receives a position signal indicating a position of the blind when a real position of the blind does not correspond to its desired position.

29. A method to prevent start of fire from a fixing chamber of a fixing station to an electrophotographic print or copy device, comprising the steps of:

at openings of the fixing chamber via which a fire can spread, providing a sealing device that can be sealed as needed, said sealing device comprising a sealing element that cooperates with a counter-element; and in the event of a fire, making the sealing element and the counter-element touch one another to create a seal to prevent fire from escaping from the fixing chamber.

30. A method to prevent start of fire from a fixing chamber of a fixing station to an electrophotographic print or copy device, comprising the steps of:

at openings of the fixing chamber via which a fire can spread, providing a sealing device that can be sealed as needed, said sealing device comprising a sealing element that cooperates with a counter-element;

in the event of a fire, making the sealing element and the counter-element touch one another to create a seal to prevent fire from escaping from the fixing chamber; and providing at least one of the sealing element and the counter-element with an elastic sealer that is flattened when the sealing element is pressed onto the counter-element such that a contact is created via which the openings of the fixing chamber are sealed air-tight.

31. A method of claim 29 wherein in the event of a fire, providing a smoke alarm signal used to create said seal.

32. A method to prevent start of fire from a fixing chamber of a fixing station to an electrophotographic print or copy device, comprising the steps of:

at openings of the fixing chamber via which a fire can spread, providing a sealing device that can be sealed as needed, said sealing device comprising a sealing element that cooperates with a counter-element;

in the event of a fire, making the sealing element and the counter-element touch one another to create a seal to prevent fire from escaping from the fixing chamber; and the sealer comprises a fiberglass tube.

33. A method to prevent start of fire from a fixing chamber of a fixing station to an electrophotographic print or copy device, comprising the steps of:

at openings of the fixing chamber via which a fire can spread, providing a sealing device that can be sealed as needed, said sealing device comprising a sealing element that cooperates with a counter-element;

in the event of a fire, making the sealing element and the counter-element touch one another to create a seal to prevent fire from escaping from the fixing chamber; and the counter-element comprises a flat surface which pushes against a flexible cylindrical surface of the sealing element to create said seal, said sealing element being flattened when the counter-element presses against it.

34. A method to prevent start of fire from a fixing chamber of a fixing station to an electrophotographic print or copy device, comprising the steps of:

at openings of the fixing chamber via which a fire can spread, providing a sealing device that can be sealed as needed, said sealing device comprising a sealing element that cooperates with a counter-element;

in the event of a fire, making the sealing element and the counter-element touch one another to create a seal to prevent fire from escaping from the fixing chamber; and providing sealing element as a strip which presses against the counter-element to create said seal.

35. The method of claim 29 wherein the counter-element comprises at least one of a planar, concave, and convex curved surface.

36. A method of claim 29 wherein the sealing element comprises a plurality of wires.

37. A safety apparatus to prevent spread of fire from a fixing chamber of a fixing station in an electrophotographic print or copy device, comprising:

at openings of the fixing chamber via which a fire can spread, a sealing device that can be sealed as needed, said sealing device comprising a sealing element that cooperates with a counter-element; and at least one of the sealing element and the counter-element changing shape after the sealing element is pressed onto the counter-element, such that a clamp region is created via which the openings of the fixing chamber are sealed fire-tight.

38. A method to prevent start of fire from a fixing chamber of a fixing station to an electrophotographic print or copy device, comprising the steps of:

at openings of the fixing chamber via which a fire can spread, providing a sealing device that can be sealed as needed, said sealing device comprising a sealing element that cooperates with a counter-element; and in the event of a fire, making the sealing element and the counter-element touch one another and create a flattened region to create a seal to prevent fire from escaping from the fixing chamber.

* * * * *